United States Patent [19]

Hermann et al.

[11] Patent Number: 4,463,690

[45] Date of Patent: Aug. 7, 1984

[54] FURNACE CHAMBER LINING STRUCTURE

[75] Inventors: Wolfgang Hermann, Erftstadt-Gymnich; Bernhard Rüter, Königsdorf; Rainer Gorris, Ratingen; Herbert Nowak, Meerbusch, all of Fed. Rep. of Germany

[73] Assignees: Rheinische Braunkohlenwerke AG, Cologne; Karrenh GmbH, Dusseldorf, both of Fed. Rep. of Germany

[21] Appl. No.: 390,144

[22] Filed: Jun. 18, 1982

[30] Foreign Application Priority Data

Jun. 19, 1981 [DE] Fed. Rep. of Germany ..... 3124263

[51] Int. Cl.[3] ..... F23M 5/00

[52] U.S. Cl. ..... 110/336; 52/404; 52/506; 126/64; 126/151

[58] Field of Search ..... 110/336; 52/404, 405, 52/506; 126/351, 64, 151

[56] References Cited

U.S. PATENT DOCUMENTS

| | | | |
|---|---|---|---|
| 2,763,321 | 9/1956 | Schuster | 126/151 |
| 3,503,111 | 3/1970 | Janecek | 29/200 |
| 4,001,996 | 1/1977 | Byrd, Jr. | 52/506 |
| 4,096,681 | 6/1978 | Netterstedt et al. | 52/506 |
| 4,333,292 | 6/1982 | Musgrave | 52/404 |

FOREIGN PATENT DOCUMENTS

| | | |
|---|---|---|
| 1174934 | 8/1959 | Fed. Rep. of Germany . |
| 2948385 | 1/1979 | Fed. Rep. of Germany . |

*Primary Examiner*—Edward G. Favors
*Assistant Examiner*—Steven E. Warner
*Attorney, Agent, or Firm*—Panitch, Schwarze, Jacobs & Nadel

[57] ABSTRACT

A lining for a furnace chamber which is at least approximately round in cross-section is divided into at least two layers in a radial direction and into at least two portions in an axial direction. A gas seal is disposed between the lining portions, the gas seal being in the form of a foil as of metal and being divided in a radial direction into at least two portions releasably connected together in such a manner as to permit the inner portion to be removed in an axial direction. The gas seal can therefore be composed of individual seal portions, in a radial direction, and can be fitted separately.

12 Claims, 9 Drawing Figures

FIG.5
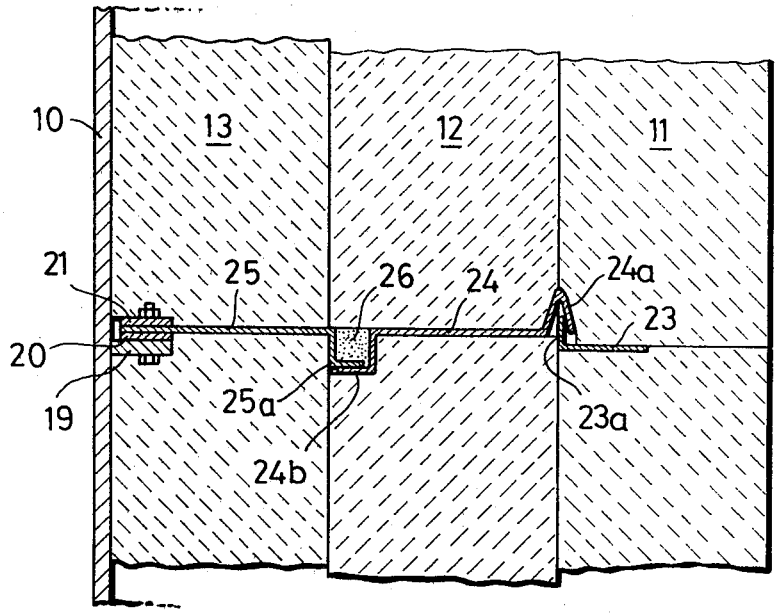
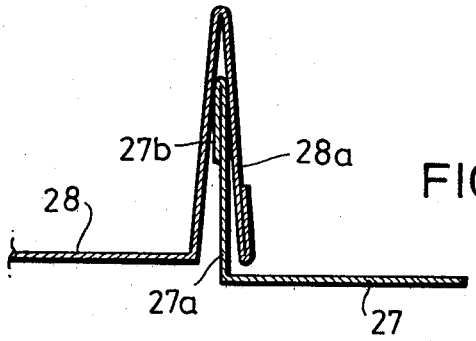
FIG.6

FURNACE CHAMBER LINING STRUCTURE

BACKGROUND OF THE INVENTION

The invention relates generally to a lining for a furnace chamber and more particularly a lining stucture for such a chamber, which is at least approximately round in cross-section.

It is known for the lining of a furnace chamber to be subdivided into at least two layers in the radial direction, and at least two portions in the axial direction, with a seal of metal material as a gas seal therebetween.

Generally, the layers of such lining arrangements are made from different materials which are suitably selected in accordance with the temperature loadings and the thermal expansion phenomena to be expected in the respective layers in question. A gas seal arrangement, also referred to as a gas barrier means, may be provided between the axially separated portions of such a lining, in order to ensure that pressure differences within the furnace chamber do not cause gas to flow in an uncontrolled manner into rearward or outer layers of the lining, thereby causing damage to the lining. Such damage may be caused mechanically, as by the formation of passages or channels or other cavities in the lining or between the layers or portions thereof. It is also possible however to conceive of damage being caused by a chemical reaction.

When metal sheet or plate is used to form the gas seal, it has been found that difficulties often still occur, which are attributable to the fact that the metal sheets or plates have different coefficients of thermal expansion from the layers of the lining, which are generally formed by ceramic material. The difference in thermal expansion may cause the metal plates to be subjected to such a severe loading that buckling occurs or cracks are formed, so that the gas seal quickly becomes ineffective as a result. Generally, such cracks are found in the transitional region between two adjacent layers of the lining.

Hitherto, the above-described gas seals made from metal plates were in one piece in a horizontal or radial direction. For that reason, it was not possible, or it was possible only to a limited and therefore unsatisfactory extent, for differences in thermal expansion in the individual layers of the furnace lining to be compensated in the axial direction, in the region of the gas seal. Further disadvantages with such gas seals, being integral in a radial direction, are that it is difficult to replace for example only the inner layer of the lining and/or it is not possible to replace only part of the gas seal, for example in a region which had suffered damage.

SUMMARY OF THE INVENTION

An object of the present invention is to provide a gas seal for a furnace chamber lining, which can adapt to differences in thermal expansion in the lining structure.

A further object of the present invention is to provide a gas seal for a furnace chamber lining which permits repairs to be made in part of the lining without full-scale dismantling of the lining.

Another object of the invention is to provide a furnace chamber lining gas seal which is less susceptible to loadings thereon caused by thermal factors.

Yet another object of the invention is to provide a gas seal for a furnace chamber lining structure, which can be easily fitted in place without complex assembly procedures or complicated equipment or tools.

Still another object of the invention is to provide a gas seal for a furnace chamber lining structure, which does not result in the integrity of the lining structure being impaired by operating stress factors in the seal.

These and other objects are attained by a lining for a furnace chamber which is at least substantially round in cross-section. The lining is subdivided into at least two layers, as viewing radially, and at least two portions, as view axially. A seal of metal material is disposed between the at least two portions of the lining, the seal being in the form of film or foil and divided in the radial direction into at least two portions, a radially inner and a radially outer portion, which are releasably connected together in such a manner as to permit removal of the inner portion in an axial direction of the lining.

As a metal foil, by its very nature, is substantially less rigid than a metal plate or sheet, such a foil gas seal can adapt to a substantially better degree to the thermal expansion which takes place in the different radial regions of the lining. This eliminates or at least reduces the danger of overloading of the gas seal, with resulting buckling or cracking. In addition, due to the foil being a thin material, the individual portions of the gas seal can be easily joined together by folding over, bending over or similar overlap connections, in such a way that the total thickness of the gas seal does not become excessive, even in the region of a join therein. In addition, different thermal expansion phenomena can be compensated, in the region of such a join. Becuase of the portions of the gas seal are releasably connected together, it is also easier to fit or replace the gas seal if repair is required, for example when it is only a part of a layer of the lining which has to be renewed. Advantageously, in accordance with a feature of the invention, the division in the seal is in the boundary region between two adjacent layers of the lining, as in such a case the seal can be fitted or replaced together with the respective lining layer.

The seal may be divided in the peripheral direction into a plurality of sector-shaped portions which overlap each other in the region of their radial edges. That ensures that the seal enjoys satisfactory capability of adaptation to the respective thermal expansion phenomena which may occur, in the peripheral direction. In this connection, it is advantageous if, of the two edges of a sector-shaped portion, one edge lies above and one edge lies below the respective edges of respective adjacent portions, with at least one and preferably only two at most of the sector-shaped portions having both edges extending over the adjacent portions. This makes it easy to fit the seal, over the periphery of the lining.

The portions of the seal, which are joined together in the boundary region between two layers of the lining, can be bent over in the axial direction to form strip portions and may bear sealingly against each other by means of such bent-over strip portions. The connecting region between two portions of the gas seal is thus disposed in a plane which extends between two adjacent layers of the lining, thus remaining accessible even after a further axial portion of the lining has been fitted; in this respect, it is also an advantage that the connecting region between the two portions of the seal is not directly loaded by the weight of the next following portion of the lining. It is also desirable in this connection for the bent-over strip portions of two adjacent seal portions to project into a gap between the layers of the lining, formed for example by a mortar joint. This ensures that there is always sufficient space in a radial direction, for forming the connecting region between two portions of the seal.

One seal portion may have a free edge of an axially extending strip portion which is folded over to form a pocket configuration into which can be inserted the free edge of an axially extending strip portion of the other seal portion. Therefore, the two portions of the seal are sealingly fitted one into the other in the manner of a plug-in connection, so that there is no need for an additional bending operation or complex tools in the gas seal assembly and disassembly procedures.

In this connection, it may be desirable for the above-mentioned pocket to be associated with the outer portion of the seal and to be bent over upwardly in the axial direction, with the axially extending strip portion of the inner portion of the seal being such that it can be pulled downwardly out of the pocket to disconnect the seal portions.

In order to achieve a further improvement in the sealing effect in the connecting region, the free edge of the respective strip portion which engages into the pocket configuration may be folded over through an angle of about 180°, to form a sealing lip. In addition, it is also possible for the free edge of the strip portion which is folded over to form the pocket configuration in turn to be folded over outwardly of the pocket, in order to strengthen the free edge of the pocket.

In accordance with a preferred feature, a portion of the seal may be composed of a segment of a ring which extends in the radial direction of the lining, and an axially extending strip portion, the ring segment and the strip portion being connected together by folding or the like engagement process. This permits the foil material to be better adapted to the arcuate configuration of the lining cross-section.

It may also be advantageous for the end surfaces of the lining layers, which surfaces define the ends of the portions of the lining, to be disposed in a stepped configuration relative to each other in the axial direction of the lining, with adjacent layers each having their own respective seal portion associated therewith, each said seal portion having an annular portion extending in a radial plane and a strip portion extending in an axial direction, while adjacent seal portions are telescopically fitted one into the other by means of their strip portions.

With this arrangement therefore the gas seal is of a stepped configuration so that the portions of the individual layers of the lining, which portions adjoin each other in the axial direction, do not need to be disposed at the same height or level in the lining. In addition, there is a sufficiently large region of overlap in the axial direction thereby further enhancing the sealing effect, without the portions of the seal having to be connected together as by folding.

The outer edge of the gas seal may be disposed between a support ring for example on the furnace casing, and a holder ring which are secured together as by screw means or joined together in some other suitable manner. The layers of the lining may also be mounted in sections on respective annular bracket means, with the outer edge of the seal being clamped between the lining and the annular bracket means.

BRIEF DESCRIPTION OF THE DRAWINGS

FIG. 5 shows a view in section through part of the lining with a further embodiment of the gas seal according to the present invention;

FIG. 6 shows a view of a connecting region between two parts of a modified embodiment of the gas seal.

DESCRIPTION OF PREFERRED EMBODIMENTS

Figure 1:
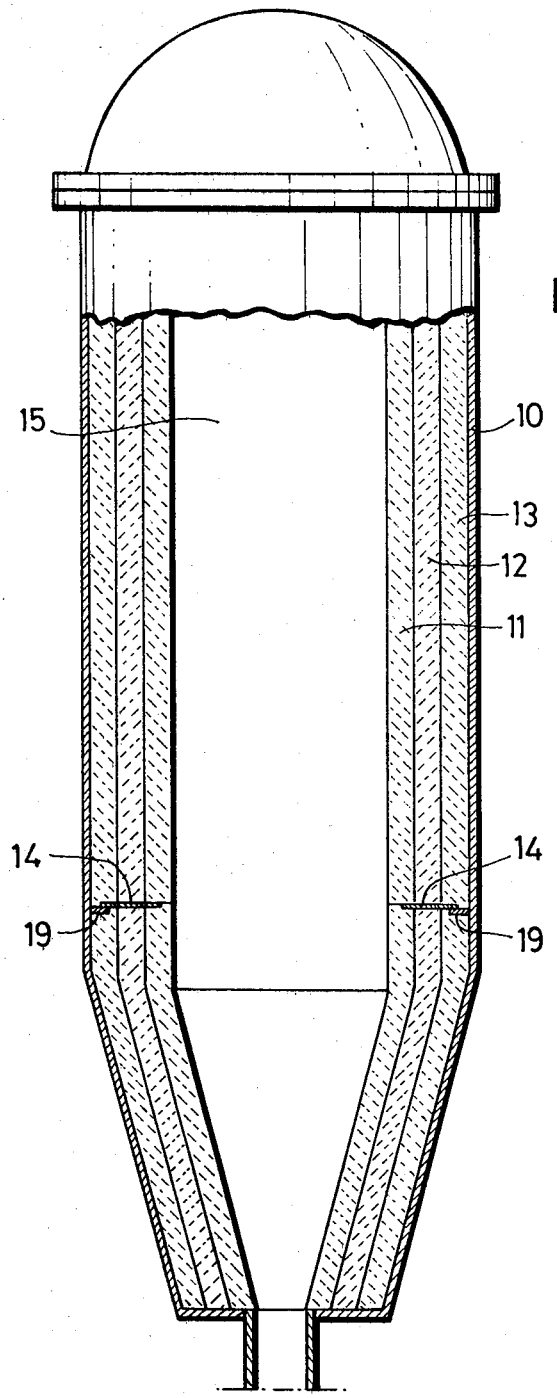
FIG. 1 shows a diagrammatic view in longitudinal section through a furnace chamber with a lining comprising three layers.

Reference will first be made to FIG. 1 for the purposes of describing the general stucture and design of a furnace chamber which in the illustrated case is in the form of a pressure reactor, for the gasification of carbon-bearing material. That operation may involve average temperatures of up to 1100° C. although peak values of up to 1500° C. may be attained. The operating pressure will generally be from 10 bars to 30 bars, although maximum values to over 100 bars may possibly be reached. Such a pressure reactor may be for example up to 4 meters in outside diameter, and up to 10 meters or more in length.

The reactor comprises an outer steel casing 10, and within the casing 10, a lining of at least approximately round cross-section, which is produced from refractory materials and which is formed by three radially separate or divided layers 11, 12 and 13. Each of the layers 11, 12 and 13 is also subdivided into at least two portions over the length of the reactor, that is to say, in the axial direction thereof. One of the two portions of the lining is disposed above a gas seal which is generally denoted by reference numeral 14, while the other portion is disposed below the gas seal 14. As the purpose of the gas seal 14 is to prevent gas from penetrating into the outer part of the lining because of pressure differences which may occur while the reaction is taking place within the chamber 15, between the upper and lower portions of the interior of the chamber 15, further gas seals will if necessary also be disposed in the higher regions of the reactor, if it is also to be expected that such pressure differences may occur in that area.

FIGS. 2 to 9 which will be described in detail hereinafter show views on a substantially larger scale of different embodiments of the gas seal 14 in itself or in conjunction with the corresponding region in which it is installed between the layers 11, 12 and 13 of the lining.

Figure 2:
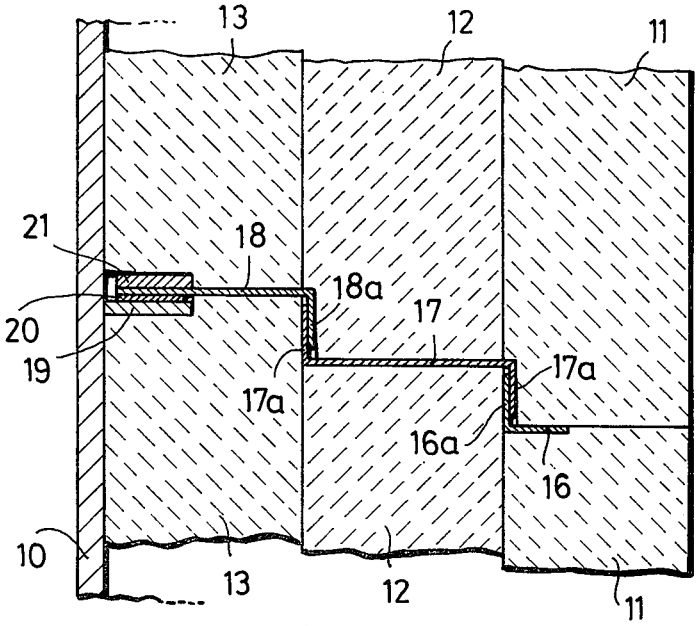
FIG. 2 shows a view in cross-section through a part of the lining, with a first embodiment of a gas seal in accordance with the principles of the present invention.

In the embodiment shown in FIG. 2, a gas seal is formed in a radial direction by three seal portions 16, 17 and 18, of which the seal portion 16 is arranged between the two portions of the layer 11 of the lining, which adjoin each other in the axial direction, the seal portion 17 is arranged between the two axially adjoining portions of the layer 12, and the seal portion 18 is arranged between the two axially adjoining portions of the layer 13. As described hereinafter for example with reference to FIG. 2 the seal portions 16, 17 and 18 may be subdivided over their periphery into individual sector-shaped portions which suitably overlap each other. As the lining is of circular cross-section, an axially extending strip portion 16*a* forming part of the seal portion 16 is of a corresponding arcuate configuration, and that applies in regard to the other axially extending strip portions of the seal portions, which are described in greater detail below, with reference to subsequent embodiments.

Like the seal portions 17 and 18 and the seal portions to be described in connection with the other embodiments, the seal portion 16 comprises a metal foil, the thickness of which is between 0.01 and 1 mm, the thickness of foil used generally being between 0.05 and 0.3 mm. It will be appreciated that it is possible to use different selected foils, within the same gas seal. The material used for the foil will advantageously be a steel with a high level of high-temperature stability or hot strength, with comparatively high proportions of alloying components, or another alloy having a high level of hot strength.

At each of its two radial ends or edges, the seal portion 17 which adjoins the seal portion 16 in a radially outward direction has a respective strip portion 17*a* which is bent to extend in an axial direction. One of the strip portions 17*a*, being the radially inward one, is bent over in a downward direction and overlaps the strip 16*a* of the seal portion 16. The strip portion 17*a* at the other, outer edge of the seal portion 17, which is bent upwardly, in turn overlaps a downwardly bent strip portion 18*a* at the inward edge of the seal portion 18. In its outer edge region, the seal portion 18 is carried on a support ring 19 which is secured as by welding to the steel casing 10 around the periphery thereof. An annular seal 20 is disposed between the seal portion 18 and the support ring 19, and a holder ring 21 which is clamped to the support ring 19 is carried on the top of the seal portion 18.

The overlap between the respective seal portions 16, 17 and 18 is such in each case that the seal portions can be separated from each other by pulling them apart in an axial direction. If for example only the lower portion of the inner layer 11 of the lining is to be replaced, then the seal portion 16 can be removed after provisionally bracing and supporting the upper portion of the lining and removing the lower portion of the layer 11, so that if necessary, the seal portion 16 can be replaced by a fresh seal portion. The overlapping strip portions 16*a* and 17*a*, 17*a* and 18*a* respectively also readily permit compensation in respect of differences in thermal expansion in an axial direction.

The foil from which the seal portions 16, 17 and 18 are made is shown both in FIG. 2 and also in the subsequent figures of drawings on a greatly enlarged scale, in comparison with the thickness of the layers 11, 12 and 13 of the lining, for better illustration.

In practice, the overlap regions are preferably disposed in a comparatively narrow gap between each two adjacent layers 11, 12 and 13 of the lining or between superposed portions of the respective layers of the lining.

Figure 3:
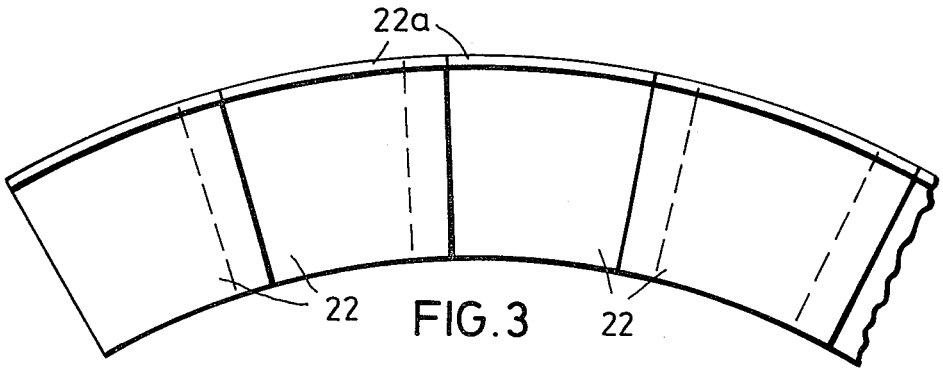
FIG. 3 shows a plan view of the gas seal in the region of a layer of the lining, viewing in the axial direction of the chamber.
Figure 4:
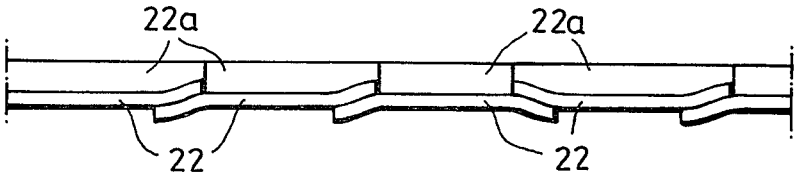
FIG. 4 shows a view of the gas seal shown in FIG. 3, but viewing in a radial direction.

FIGS. 3 and 4 show a possible form of the structure of the gas seal in the peripheral direction. In order to simplify the view, FIG. 4 is illustrated as a development of the structure shown in FIG. 3. The seal members 22 which overlap in the peripheral direction have strip portions 22*a* which are bent upwardly in an axial direction, and the members 22 overlap in such a way that, of the two edges, which are disposed in the peripheral direction, of each seal member 22, one edge lies above the respective edge of a respective adjoining seal member 22, while the other edge of the first-mentioned seal member 22 lies below the edge of the other respective adjoining member 22. Only two of the seal members extend over both edges of the adjoining seal members 22, those seal members being fitted as the first and last portions of the gas seal.

In the embodiment shown in FIG. 5, the gas seal is once again divided in a radial direction into three seal portions 23, 24 and 25. The inner seal portion 23 which is associated with the layer 11 has a strip portion 23*a* which is bent upwardly in FIG. 5. At its side which is towards the seal portion 23, the adjacent seal portion 24 has a strip portion 24*a* bent substantially into a V-shaped configuration to form a pocket which engages over the strip portion 23*a* of the seal portion 23 or into which said strip portion 23*a* can be inserted.

At its outward edge, the seal portion 24 has a strip portion 24*b* which is firstly bent downwardly (in FIG. 5) and then outwardly and the horizontal limb of which is an overlapping relationship with the horizontal limb of a strip portion 25*a*, which is formed in the same manner, of the adjoining seal portion 25. This region of overlap occurs in a groove-like recess or opening 26 of approximately square cross-section, which is formed in the middle layer 12 of the lining and which is then filled with a sealing or filling material in the form of mortar, fibre material or the like. With this construction, there is a comparatively large overlap region in the radial direction, so that substantial thermal expansion can be accordingly satisfactorily compensated therein.

The outer seal portion 25 is secured in place in the same manner as in the embodiment shown in FIG. 2, by means of a support ring 19, a seal 20 and a holding ring 21.

FIG. 6 shows a modified form of the connection between two adjacent seal portions 27 and 28. The seal portion 27 has an edge strip portion 27*a* which is bent over to extend in the axial direction (upwardly in FIG. 6) and the free edge of which in turn bent over through 180° to form a sealing lip as at 27*b*. By virtue of this configuration, the edge of the seal portion 27 can be better adapted to the shape of a strip portion 28*a* of the seal portion 28, the strip portion 28*a* being bent over to form a V-shaped pocket configuration. The free edge of the strip portion 28*a* is in turn bent outwardly through 180°, in order to improve the strength situation in that region. Therefore, in this case also the connection between the seal portions 27 and 28 is made by simply fitting the seal portions 27 and 28 one into the other.

Figure 7:
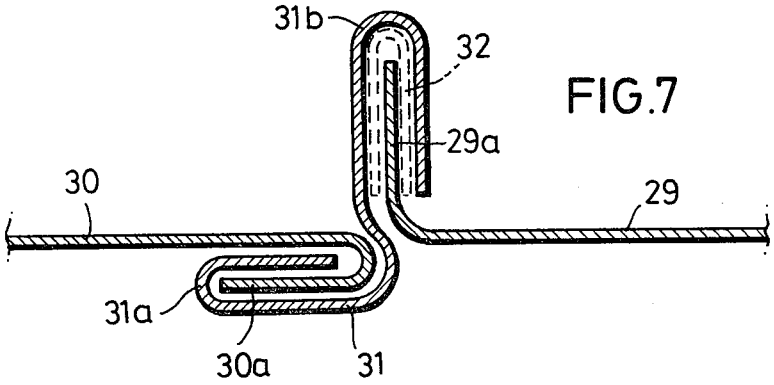
FIG. 7 shows a further embodiment of the gas seal, in the connecting region thereof, FIG, 8 shows a further modified embodiment of a gas seal, in the adjoining region between two layers of a furnace chamber lining.

In the embodiment shown in FIG. 7, two seal portions 29 and 30 do not lie directly against each other, as in the above-described embodiments but are connected together by a connecting member 31. The seal portion 29 has a strip portion 29*a* which is bent upwardly in the axial direction. The connecting member 31 is connected to the seal portion 30 by two fold portions 30*a* and 31*a*. Adjoining the fold portion 31*a*, the connecting member 31 forms a second portion 31*b* which is also of U-shaped configuration and which extends substantially at a right angle to the fold portion 31*a* and which extends around the strip portion 29a of the seal portion 29. In this case also the connecting portion 31 is of such a shape and configuration that the seal portion 29 can be inserted or removed in the axial direction. In order to enhance the sealing effect in this region, a seal 32 may additionally be disposed between the strip portion 29a and the U-shaped portion 31b, which is disposed therearound, of the connecting member 31.

Figure 8:
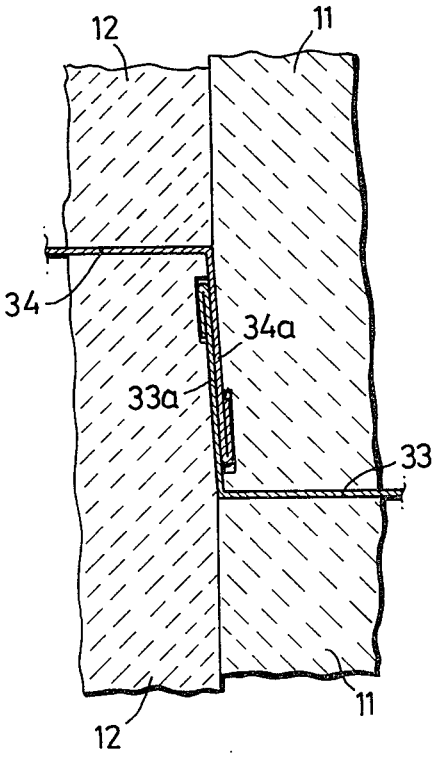

Reference will now be made to FIG. 8 showing only the adjoining region between two layers 11 and 12 of the lining. Associated with the layer 11 is a seal portion 33 which has a strip portion 33a which is bent upwardly substantially in the axial direction. The strip portion 33a is in turn bent outwardly through 180° at its free edge. The same situation also applies in regard to a strip portion 34a, which is formed in the same manner, on the seal portion 34 associated with the layer 12. With the exception of the 180°-bent portions of the strip portions 33a and 34a, this embodiment of the gas seal is similar to the embodiment shown in FIG. 2. However, the region of overlap is now even greater in the axial direction of the lining.

Figure 9:
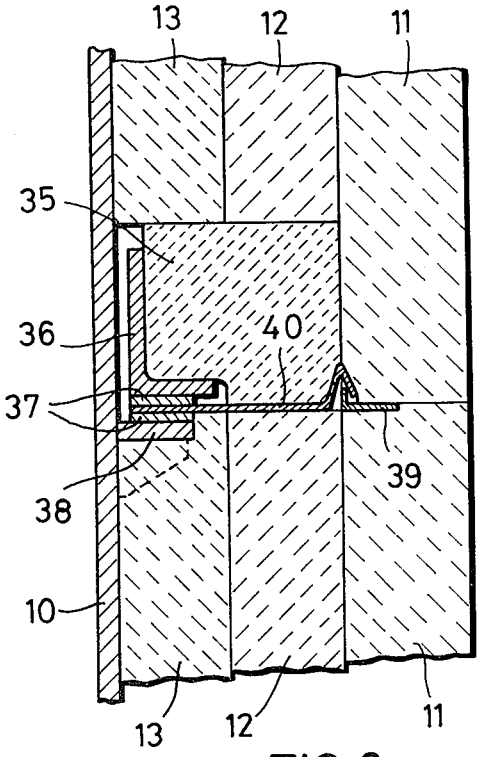
FIG. 9 shows an arrangement of a gas seal in the outer edge region of a furnace chamber lining.

In the embodiment shown in FIG. 9, only the layer 11 of the lining is divided above and below the gas seal in the axial direction. In the region of the layers 12 and 13 of the lining, the upper portion of the lining is supported on bracket blocks 35 which are held in a support ring 36 of L-shaped cross-section. Instead of the bracket blocks 35, it is also possible to use a concrete ring which is of a continuous configuration around the periphery of the arrangement or which is formed from segment-like portions. The support ring 36 is supported by way of two seals 37 on a support bracket 38 which in turn is secured as by welding to the steel casing 10.

A seal portion 39 associated with the inner layer 11 and a seal portion 40 associated with the other two layers 12 and 13 are connected together in the same manner as for example the seal portions 23 and 24 in the embodiment shown in FIG. 5, the outer seal 40 being clamped between the two seals 37.

It will be seen therefore that the gas seals as described above can adapt to different thermal expansion in the lining stucture, and permit repairs to be made to the lining, without total dismantling thereof. The seal adapts well to thermally induced stress produced therein, and is easy to fit and remove, without destroying the integrity of the chamber lining.

It will be appreciated that the above-described embodiments are described by way of example only and that various modifications may be made therein without thereby departing from the spirit and scope of the present invention.

What is claimed is:

1. A lining for a furnace, which lining is generally circular in cross section and which is divided in a radial direction into at least two layers interior and exterior and in an axial direction into at least two sections including a gas seal comprised of at least two adjacent portions of thin metal material, the seal portions including a first sub-portion extending axially between the lining layers and a second sub-portion perpendicular to the first sub-portion and extending radially between the lining sections, characterized in that the seal portions are releasibly connected to form a generally continuous gas seal extending from the radial interior to the radial exterior of the lining, the first sub-portions of radially adjacent seal portions being detachably joined in an overlapping manner between adjacent lining layers to permit the removal of a radially interior seal portion by axial movement.

2. A lining according to claim 1, characterized in that the overlapping first sub-portions are in contact with each other and arranged in a side by side manner between the lining layers.

3. A lining according to claim 2, characterized in that at least one of the two overlapping first sub-portions is folded back to form a pocket configuration to receive at least a distal end of another overlapping first sub-portion.

4. A lining according to claim 3, characterized in that individual seal portions are positioned in lining joints arranged at different heights, overlapping first sub-portions bridging the difference in height between two adjacent seal portions.

5. A lining according to claim 3 characterized in that said pocket configuration is open at its lower side.

6. A lining according to claim 4, characterized in that the pocket configuration is fixed to that one of two adjacent seal portions which is arranged higher than the other seal portion, part of the first sub-portion of the latter is received in the pocket configuration of the former.

7. A lining according to claim 4 characterized in that the pocket configuration is associated with the exterior seal portion of two adjacent seal portions.

8. A lining according to claim 4 characterized in that the remaining part of the first sub-portion of the portion which is not associated with the pocket configuration is folded through an angle of about 180 degrees to form a sealing lip.

9. A lining according to claim 1, characterized in that the most radially exterior seal portion is clamped with an outer edge between a support ring and a holder ring.

10. A lining according to claim 9 characterized in that the layers of the lining are mounted in sections on respective annular support bracket means, the outer edge of the most exterior seal portion being clamped between the lining and said support bracket means.

11. A lining according to claim 1, characterized in that the seal is divided in the peripheral direction into a plurality of sector-shaped portions having adjacent radial ends overlapping each other.

12. A lining according to claim 11, characterized in that said sector shaped portions include two edges one edge lies above and one edge lies below respective edges of respective adjacent seal portions, and wherein at least one of said sector-shaped portions has both its edges engaging over the adjacent seal portions.

* * * * *

UNITED STATES PATENT AND TRADEMARK OFFICE

CERTIFICATE OF CORRECTION

PATENT NO. : 4,463,690

DATED : August 7, 1984

INVENTOR(S) : Wolfgang Hermann, et al.

It is certified that error appears in the above-identified patent and that said Letters Patent is hereby corrected as shown below:

On the title page,
Item [73] of the above-identified patent should read as follows:

Assignees: Rheinische Braunkohlenwerke AG, Cologne; Karrena GmbH., Dusseldorf, both of Fed. Rep. of Germany.

Signed and Sealed this

*Twelfth* Day of *March 1985*

[SEAL]

*Attest:*

DONALD J. QUIGG

*Attesting Officer* *Acting Commissioner of Patents and Trademarks*